US006053005A

United States Patent [19]

Boitnott

[11] Patent Number: 6,053,005

[45] Date of Patent: Apr. 25, 2000

[54] METHOD OF AND KIT FOR PROTECTING THE INTEGRITY OF REFRIGERATION SYSTEMS

[76] Inventor: Gregory J. Boitnott, 140 Katy View Ridge, St. Charles, Mo. 63303

[21] Appl. No.: 09/249,175

[22] Filed: Feb. 12, 1999

[51] Int. Cl.[7] ..... F25D 19/00

[52] U.S. Cl. ..... 62/298; 137/384; 206/459.1; 206/459.5; 206/460; 206/497; 206/807

[58] Field of Search ..... 62/77, 298, 299, 62/125; 206/459.1, 459.5, 460, 497, 807; 137/384

[56] References Cited

U.S. PATENT DOCUMENTS

| | | | |
|---|---|---|---|
| 1,006,087 | 10/1911 | Hertzberg . | |
| 2,818,168 | 12/1957 | Tobey et al. | 206/56 |
| 4,119,128 | 10/1978 | Bishop | 150/8 |
| 4,505,218 | 3/1985 | Fiarman et al. | 116/200 |
| 5,191,992 | 3/1993 | Darley | 220/214 |
| 5,225,162 | 7/1993 | Scoville | 422/56 |
| 5,241,982 | 9/1993 | Taylor . | |
| 5,312,680 | 5/1994 | Simpson | 428/321.5 |
| 5,495,944 | 3/1996 | Lermer | 206/459.1 |
| 5,770,283 | 6/1998 | Gosselin et al. | 428/35.7 |

*Primary Examiner*—Henry Bennett
*Assistant Examiner*—Marc Norman
*Attorney, Agent, or Firm*—Howell & Haferkamp, L.C.

[57] ABSTRACT

A security kit and method for protecting refrigerant systems is provided with a seal member for each service port of an air conditioning system. The kit may also include a validation record for recording identifying indicia from each of the seal members. The seal members are heat shrinkable plastic sleeves adapted to be secured on service ports and heated to shrink around and conform to the service port, substantially interfering with the use of the service port. The seal member is not removable without perceptible alteration. A kit can be provided with seal members for one or more service ports.

18 Claims, 2 Drawing Sheets

METHOD OF AND KIT FOR PROTECTING THE INTEGRITY OF REFRIGERATION SYSTEMS

FIELD OF THE INVENTION

This invention relates to refrigeration systems, and in particular to a method of, and a kit for, protecting the integrity of refrigeration systems.

BACKGROUND OF THE INVENTION

Because of increasing concerns over the environmental impact of fluorocarbon refrigerants such as freons, and legal restrictions on their manufacture, sale, and use, reliable sources of refrigerants are increasingly difficult to find. One consequence of this fact is that refrigeration systems are frequently contaminated with mixtures of different refrigerants and/or other substances. Contamination of refrigeration systems is a serious problem for those service technicians responsible for repairing and maintaining these systems, and particularly for those who warrant their work. Prior to the present invention, when a complaint was made about repair or maintenance of a refrigeration system, a service technician could not determine whether or not the system had been tampered with subsequent to the servicing. Thus, some service technicians have had to honor warranty claims where the failure of the system was not due to the original servicing, but to subsequent tampering.

SUMMARY OF THE INVENTION

The present invention is directed generally to a kit for protecting the integrity of a refrigeration system by preventing undetected tampering with the system. Refrigeration systems, such as air conditioning (A/C) systems for motor vehicles, and in particular automobiles, generally provide service ports for charging refrigerant to, and discharging refrigerant from, the system. The kit of the present invention comprises a seal member for each service port. Each seal member is adapted to be secured on a service port in a way that substantially interferes with the use of the service port. Once secured on the service port, the seal member cannot be removed from the service port without perceptible alteration of the seal member. Each seal member preferably bears identifying indicia. The seal member is preferably a heat-shrinkable sleeve that can be slipped over the service port, and secured by heat-shrinking the sleeve over the service port.

The kit may also include a validation record for recording the identifying indicia from each seal member installed on a service port of the refrigeration system. This validation record may be, for example, an adhesive label with spaces for recording the identifying indicia from each seal member. Alternatively the identifying indicia from the seal members in the kit can be preprinted on the validation record. The validation record can be secured adjacent the system or on service records for the system, to provide a ready reference to make sure that the seal members have not been changed.

The present invention is also directed generally to a method for protecting the integrity of a refrigeration system by preventing undetected tampering with the system. The method comprises securing a seal member on each service port of the refrigeration system. The seal member substantially interferes with the use of the service port, and is not removable without perceptible alteration of the seal member. The sealing member is preferably a heat shrinkable sleeve, which is placed over the service port, and secured by heating the sleeve to shrink the sleeve around the service port.

Each seal member preferably includes identifying indicia, and the method includes securing a validation record bearing the identifying indicia in the vicinity of the refrigeration system. The identifying indicia may be recorded on the validation record, or for convenience the identifying indicia may be preprinted on the validation record.

These and other features and advantages of the security kit and method for protecting refrigerant systems will be in part apparent, and in part, pointed out, in more detail as set forth below.

DETAILED DESCRIPTION OF PREFERRED EMBODIMENTS

Figure 1:
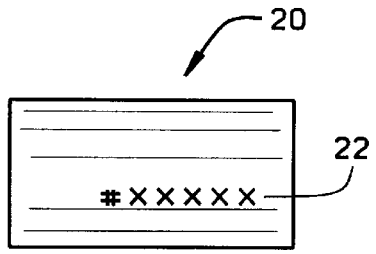
FIG. 1 is a side elevation view of the seal member of the first embodiment.
Figure 2:
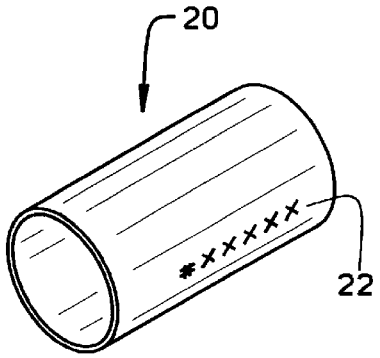
FIG. 2 is a perspective view of a seal member constructed according to the principles of a first embodiment of the present invention.
Figure 3:
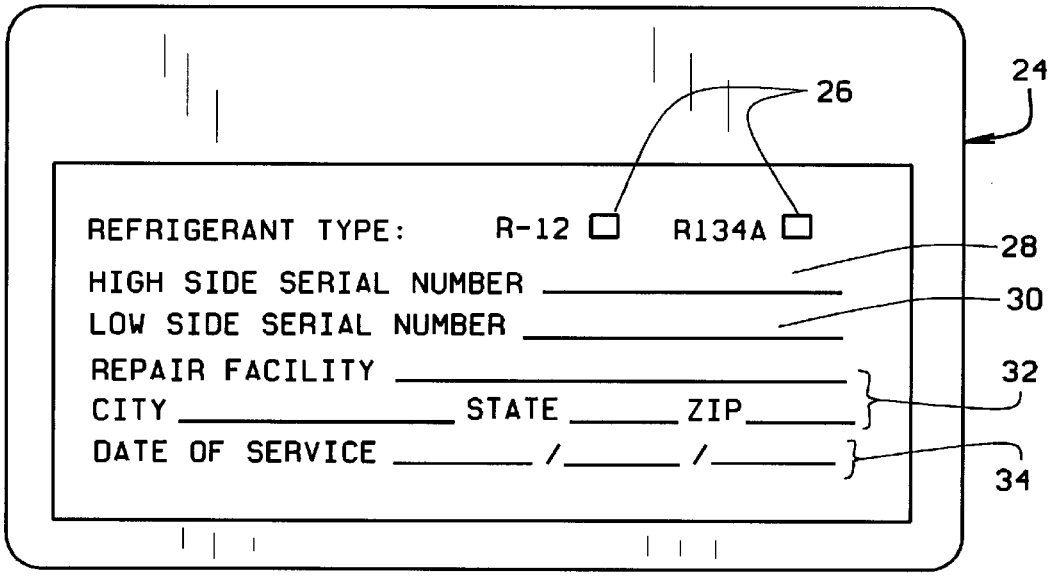
FIG. 3 is a plan view of the validation record of the present invention.

The present invention provides method of, and kit for, protecting the integrity of refrigeration systems. The method employs, and thus the kit includes, at least one seal member, indicated generally as 20 in FIGS. 1 and 2, adapted to be placed upon each service port of the refrigeration system. The seal member 20 substantially covers the service port substantially interfering with the use of the service port, i.e. preventing refrigerant from being introduced into or removed from the refrigeration system via the service port.

In this first preferred embodiment, the seal member 20 is a protective cylindrical sleeve. The seal member 20 is preferably made of a heat shrinkable plastic material so that when the seal member is heated with a heat gun, it shrinks around and substantially conforms to the service port on which it is placed. The seal member is preferably a distinctive, bright color so that it can be quickly and easily identified.

The seal member 20 is sized so that when it is secured on the service port of a refrigeration system, the seal member completely surrounds the circumference of the service port and also extends over the end of the service port. The seal member 20 thus substantially interferes with the use of the service port. Once secured on the service port, the seal member 20 cannot be removed from the service port without noticeable alteration of the seal member. Attempting to access the service port will result in damage to the seal member, providing a clear indication that the refrigeration system has been tampered with.

The seal member 20 preferably includes a unique identifying indicia 22. The identifying indicia 22 allows the seal member 20 to be identified, so that replacement of the seal member 20 can be detected. The identifying indicia may be, for example, a serial number comprising a series of alphanumerical characters, represented by "#XXXXX" in the drawings. The identifying indicia 22 can be recorded, for example, in the service records for the refrigeration system, so that at the next servicing the identifying indicia on the seal members on the service ports of the system can be compared with the records to determine whether or not the seal members have been replaced since the last authorized servicing.

Alternatively, a validation record 24 can be provided for recording the identifying indicia 22 on the seal member or members 20. Where the refrigeration system has more than one service port, and thus more than one seal member 20 is used, the identifying indicia 22 on the seal members can all be the same, or each seal member can have a unique identifying indicia. The validation record 24 can have blanks for recording the identifying indicia 22 from the seal member or members 20, or the identifying indicia on the seal members can be pre-printed on the validation record.

As discussed above, the validation record may provide blanks 26 for the recording of the refrigerant type, blanks 28 for recording the identifying indicia on the seal member on the high pressure side, blanks 30 for recording the identifying indicia on the serial number on the seal member on the low pressure side, blanks 32 for recording the name and address of the repair facility, and blanks 34 for recording the date of service. Blanks may be provided for recording additional information or different information to further reference and protect the service work performed.

The validation record 24 is preferably an adhesive label that can be secured in proximity to the refrigeration system or in the service records for the refrigeration system. The validation record 24 has a pressure sensitive adhesive label with a removable backing. The backing is peeled away to expose the adhesive, and the validation record 24 is secured to the refrigeration system or to the structure adjacent the refrigeration system.

The kit of the present invention comprises a seal member 20 for each service port in the refrigeration system for which the kit will be used. Each seal member 20 in the kit can have a unique identifying indicia 22, or all of the seal members intended for use on the same refrigeration system can have the same identifying indicia. In addition to, or instead of a serial number, the identifying indicia 22 on the seal members 20 can include a security device, such as a difficult to reproduce design, such as a holographic label, to make it more difficult to counterfeit a seal member. In the preferred embodiment, the kit is adapted for a refrigeration system that has two service ports SP, such as the air conditioning systems shown in FIG. 5. There is one service port SP on the high pressure side of the systems, and one service port on the low pressure side of the system. Each seal member 20 may be constructed of a heat shrinkable plastic material, or other suitable material that conforms to and encloses the service port on which it is installed.

Figure 5:
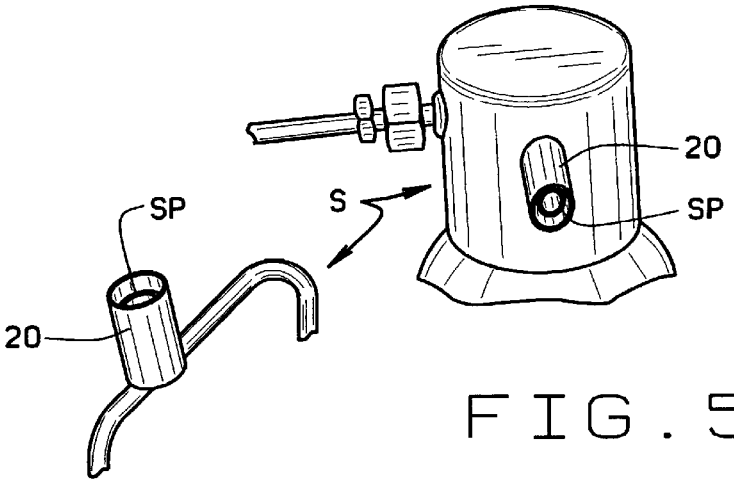
FIG. 5 is a perspective view of two service ports of a refrigeration system, showing seal members of the first embodiment placed thereon.
Figure 6:
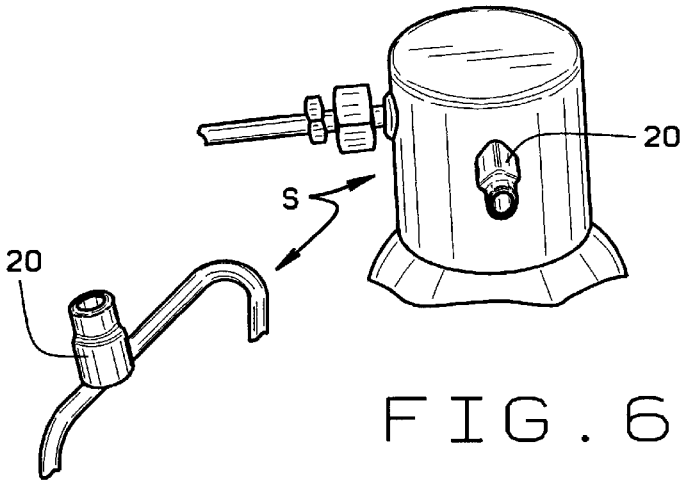
FIG. 6 is a perspective view of the two service ports shown in FIG. 5, with the seal members of the first embodiment secured thereon.

As shown in FIG. 5 and 6, according to the method of this invention, seal members 20 are positioned over the service ports SP in a refrigeration system, such as the air conditioning systems in a motor vehicle. The seal members 20 are positioned to substantially surround the service port SP, with the ends of the seal member extending beyond the ends of their respective service ports. The seal member 20 is then secured on the service port SP. In the preferred embodiment this is quickly and easily accomplished by heating the seal member 20 with a heat gun to shrink it around the service port SP. The seal members closely conform to the sides of their respective service ports and the portion of the seal member that extends beyond the end of the seal member close or at least partially close to the end of the service port. The sealing member 20 thus substantially encloses the service port SP sufficiently to prevent the introduction or removal of refrigerant from the service port without noticeable tampering of the seal member.

The identifying indicia 22 on the seal members 20 can be recorded on a validation record 24 (or this indicia may be pre-printed on the validation record 24), and the validation record is secured near the refrigeration system or in the service records for the refrigeration system.

Figure 7:
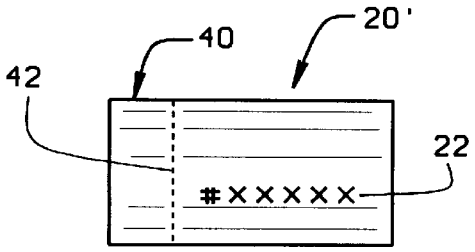
FIG. 7 is a side elevation view of the seal member of the second embodiment.
Figure 8:
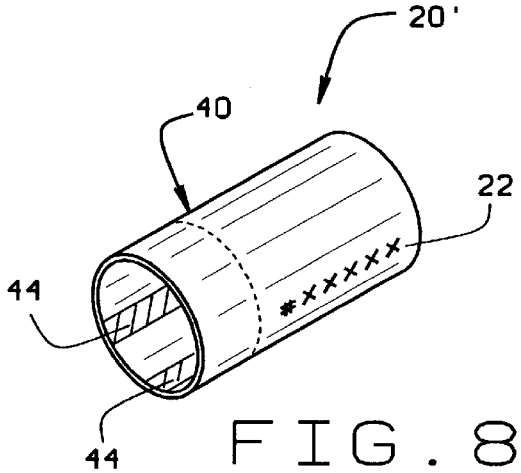
FIG. 8 is a perspective view of a seal member constructed according to the principles of a second embodiment of this invention; and Corresponding reference numerals indicate corresponding parts throughout the several views of the drawings.

A seal member constructed according to the principles of a second embodiment of this invention is indicated generally as 20' in FIGS. 7 and 8. The seal member 20' is similar in construction to seal member 20, except that seal member 20' has at least one line of weakness 40, which in this second preferred embodiment is at least line of perforations 42. The line of weakness 40 facilitates the destruction of the seal member when someone attempts to remove the seal member 20' from a service port SP. This line of weakness 40 preferably extends circumferentially around the cylindrical member intermediate the ends, but is preferably closer to the end of the seal member that is oriented toward the end of the service port SP.

In this second preferred embodiment, the interior surface of the cylindrical seal member may further be provided with an adhesive, for examples lines 44 of a heat-activated adhesive. The adhesive helps to temporarily secure the seal member to the service port SP and in cooperation with the lines of weakness 40, prevents the undetected removal of the sealing members from service ports SP. Thus when the seal member 20' is heat shrunk onto the service port, the strips 44 of heat sensitive simultaneously secure the seal member on the service port. The perforated seal member 20' provides for protection of service ports that are smooth with no ridges or edges (e.g., tubular). Attempting to access the service port once the seal member 20' has been secured will result in the separation of the seal member at the circumferential perforation 42, providing a clear indication that the system has been tampered with.

Operation

Figure 4:
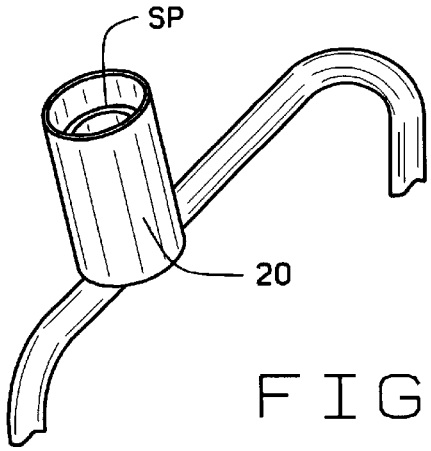
FIG. 4 is a perspective view the service port of a refrigeration system, showing a seal member of the first embodiment secured thereon.

As shown in FIGS. 4–6, the method of protecting a refrigeration system of the present invention comprises securing the seal member 20 on each service port SP of the refrigeration system, such that the seal member 20 substantially interferes with the use of the service port SP and is not removable from the service port SP without perceptible alteration of the seal member 20. Identifying indicia 22 on the seal member 20 can be recorded on a validation record 24, to provide a reference to the service work performed. This prevents the seal member 20 from being removed and replaced. The validation record 24 bearing the recorded identifying indicia 22, and other information, can be secured in the vicinity of the air conditioning system SP. In the preferred embodiment, the validation record 24 is a pressure sensitive adhesive label that can be secured on or adjacent to the refrigeration system.

As shown in FIG. 4, the seal member 20 is placed surrounding the service port SP by a service provider. In a system with two service ports, a seal member 20 is placed on each of the service ports SP, as shown in FIG. 5. Once the seal members 20 are positioned on the service ports SP, they are heated for example with a heat gun to shrink them around the service ports SP, as shown in FIG. 6. This results in the seal member 20 preventing access to the service ports SP, and thereby allows any tampering with the system to be detected.

While the present invention has been described by reference to specific embodiments, it should be understood that modifications and variations of the invention may be constructed without departing from the scope of the invention defined in the following claims.

What is claimed is:

1. A kit for preventing undetected tampering with an air conditioning system having at least one service port, the kit comprising:

a seal member for each service port, each seal member adapted to be secured on a service port in a way that substantially interferes with use of the service port, and once secured on a service port, not being removable from the service port without perceptible alteration of the seal member, the seal member bearing unique identifying indicia, and a validation record for recording the identifying indicia from each seal member installed on a service port of the air conditioning system, the validation record comprising an adhesive label with spaces for recording the identifying indicia from each seal member.

2. The kit according to claim 1 wherein the kit is adapted for an air conditioning system that has two service ports, one on the high pressure side of the system and one on the low pressure side of the system, the kit having two seal members.

3. The kit according to claim 1 wherein each seal member is a heat-shrinkable plastic sleeve.

4. The kit according to claim 1 wherein the identifying indicia includes a serial number.

5. The kit according to claim 4 wherein the serial number on each seal member in the kit is different.

6. The kit according to claim 4 wherein the serial number on each seal member in the kit is the same.

7. The kit according to claim 1 wherein the identifying indicia includes a difficult to reproduce security element.

8. A kit for preventing undetected tampering with an air conditioning system having at least one service port, the kit comprising:

a seal member for each service port, each seal member adapted to be secured on a service port in a way that substantially interferes with use of the service port, and once secured on a service port, not being removable from the service port without perceptible alteration of the seal member, the seal member bearing unique identifying indicia, and a validation record for recording the identifying indicia from each seal member installed on a service port of the air conditioning system, the validation record comprising an adhesive label on which identifying indicia from each seal member is pre-printed.

9. The kit according to claim 8 wherein the kit is adapted for an air conditioning system that has two service ports, one on the high pressure side of the system and one on the low pressure side of the system, the kit having two seal members.

10. The kit according to claim 8 wherein each seal member is a heat-shrinkable plastic sleeve.

11. The kit according to claim 8 wherein the identifying indicia includes a serial number.

12. The kit according to claim 11 wherein the serial number on each seal member in the kit is different.

13. The kit according to claim 11 wherein the serial number on each seal member in the kit is the same.

14. The kit according to claim 8 wherein the identifying indicia includes a difficult to reproduce security element.

15. A method of protecting an air conditioning system from undetected tampering, the method comprising:

securing a seal member on each service port of the air conditioning system, the seal member substantially interfering with use of the service port, and not being removable from the service port without perceptible alteration of the seal member, wherein the each seal member bears identifying indicia;

recording the identifying indicia of each sealing member on a validation record wherein the identifying indicia includes a serial number, and wherein recording the identifying indicia on the validation records comprises writing the serial number of each sealing member on the validation record, and the validation record comprising a pressure sensitive adhesive label.

16. The method according to claim 15 further comprising securing the validation record bearing recorded identifying indicia from each seal member in the vicinity of the air-conditioning system.

17. The method according to claim 15 further comprising securing a validation record bearing identifying indicia of each seal member in the vicinity of the air-conditioning system.

18. The method according to claim 15 wherein the seal member is a heat-shrinkable sleeve, and wherein securing the seal member on the service port comprises placing the sleeve on the service port, and heating the sleeve to shrink the sleeve around the service port.

* * * * *